US005201260A

United States Patent [19]

Fetting et al.

[11] Patent Number: 5,201,260

[45] Date of Patent: Apr. 13, 1993

[54] HYDROSTATIC MACHINE

[75] Inventors: Dieter Fetting, Bretzfeld; Dieter Weigle, Ludwigsburg, both of Fed. Rep. of Germany

[73] Assignee: Robert Bosch GmbH, Stuttgart, Fed. Rep. of Germany

[21] Appl. No.: 475,321

[22] Filed: Feb. 5, 1990

[30] Foreign Application Priority Data

Feb. 25, 1989 [DE] Fed. Rep. of Germany ..... 3905936

[51] Int. Cl.[5] ..... F04B 1/04

[52] U.S. Cl. ..... 91/491; 417/273

[58] Field of Search ..... 417/269, 273; 92/121, 92/72, 58; 91/491, 481, 484

[56] References Cited

U.S. PATENT DOCUMENTS

| | | | |
|---|---|---|---|
| 2,608,933 | 9/1952 | Ferris | 91/491 |
| 2,620,733 | 12/1952 | Overbeke | 91/491 |
| 2,972,961 | 2/1961 | Clark | 91/491 |
| 3,056,357 | 10/1962 | Bohnhoff | 92/58 |
| 3,913,454 | 10/1975 | Nelson | 417/273 |
| 4,261,250 | 4/1981 | Ohrberg | 91/491 |
| 4,411,190 | 10/1983 | Kilmer | 91/491 |

FOREIGN PATENT DOCUMENTS 2748455 7/1978 Fed. Rep. of Germany .

*Primary Examiner*—Richard A. Bertsch
*Assistant Examiner*—Peter Korytnyk
*Attorney, Agent, or Firm*—Michael J. Striker

[57] ABSTRACT

A hydrostatic machine comprises a shaft, a rotor arranged on a shaft for rotation and having radially extending opening, a plurality of pistons arranged in the radial openings and having ends extending outwardly beyond the openings, a displacement curve arranged so that the ends of the pistons slide on the curve, channels for communicating the openings with a pressure medium and including passages which open laterally at the rotor, and a device for compensating an axial thrust applied by a pressure medium to the rotor and including pressure medium-actuated additional pistons.

3 Claims, 4 Drawing Sheets

HYDROSTATIC MACHINE

BACKGROUND OF THE INVENTION

The present invention relates to a hydrostatic machine. More particularly, it relates to a hydrostatic machine which has a rotor arranged on a shaft and having a plurality of radial openings with pistons accommodated therein and sliding with their free ends against a displacing curve, and which has a device for compensation of the axial thrust applied on the rotor by a pressure medium.

Hydrostatic machines of the above mentioned general type are known in the art. In a known hydrostatic machine the thrust force which acts on the rotor is taken by pressure-loaded pistons acting on the rotor and supported in the openings of the housing cover. In other words, the thrust force must be taken by the housing cover. This approach is however not favorable, since the housing cover must be constructed respectively thicker or stronger to take the forces and to accommodate the pistons. Thereby the machine is rather complicated. Such a machine is disclosed, for example in the German document DE-OS 2,748,455.

SUMMARY OF THE INVENTION

Accordingly, it is an object of the present invention to provide a hydrostatic machine of the above mentioned general type, which avoids the disadvantages of the prior art.

In keeping with these objects and with others which will become apparent hereinafter, one feature of the present invention resides, briefly stated, in a hydrostatic machine in which the device for compensating the axial thrust applied by the pressure medium to the rotor includes a disc which is fixedly mounted on the shaft so that the additional pistons arranged in the openings of the housing abut against the disc, and the shaft and the rotor are formed of one piece with one another.

In accordance with another embodiment, the device includes a first disc fixedly mounted on the shaft so that the additional pistons arranged in the openings of the rotor abut against the disc, a second disc is fixedly arranged on the shaft and forms a mechanical axial bearing and abuts against a sliding disc fixedly arranged on the housing of the machine, and the rotor is formed as a separate part.

When the hydrostatic machine is designed in accordance with these features, the thrust force is short-closed through the shaft of the machine and transmitted to the housing. This is advantageous in the sense of strength, noise suppression and space consumption.

In accordance with a further feature of the present invention, the openings which accommodate the pistons can be distributed uniformly over a circle. The pistons can be formed of a metallic material with high sliding properties.

The first disc of the second embodiment of the invention can be provided with a cylindrical projection which is fitted on the shaft of the rotor. It can serve for driving the rotor which is rotatably arranged on the shaft.

In this embodiment the pressure-loaded pistons can be composed of synthetic plastic material and arranged at uniform distances in the recesses at the end side of the rotor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
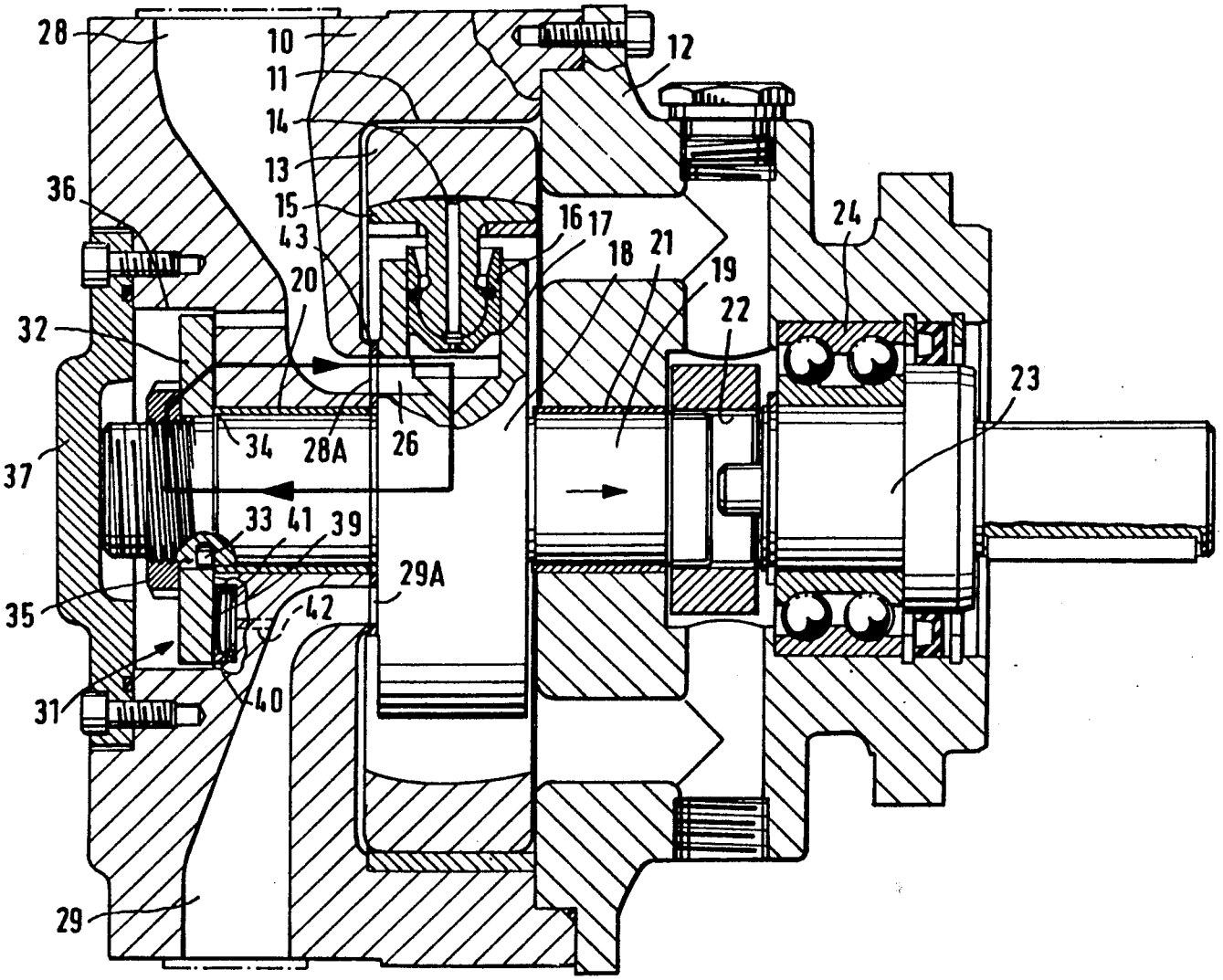
FIG. 1 is a view showing a longitudinal section of a hydrostatic machine in accordance with one embodiment of the present invention.

A radial piston machine in accordance with the present invention has a housing which is identified as a whole with reference numeral 10 and provided with a cylindrical inner chamber 11, and a cover 12 which closes the chamber. A displacement ring 13 is supported in the inner chamber. Sliding shoes 15 of pistons 16 slide on a concave inner side 14 of the displacement ring 13. The pistons 16 are located in radial openings 17 of a rotor 18.

The rotor is connected with a shaft 19 of one piece with the latter. The shaft 19 in turn is supported in a throughgoing opening 20 of the housing 10 and throughgoing opening 21 of the cover 12. The shaft 19 is driven via a coupling device 22, and more particularly through a drive pin 23 which is supported in a double roller bearing 24 arranged in the cover 12. At least one slot 26 opens axially into each opening 17 which accommodates the piston 16. The slots 26 are brought in communication with two substantially kidney-shaped openings 28A and 29A or inlet and outlet passages 28 and 29 provided in the housing 10. The above described construction of the radial piston machine is known and therefore not explained in detail.

The pressure medium flowing under high pressure in the outlet passage 29 actuates through the slots 26 an axial stroke of the rotor 18, together with the shaft 19 in direction toward the drive pin 23. This axial stroke is high and taken up by a hydrostatic device 31 for thrust compensation. The hydrostatic device has a disc 32 which is fixedly connected with the shaft 19 by a pin 33 for joint rotation therewith and abuts against a shaft shoulder 34. It is firmly clamped by a nut 35 screwed on the shaft. An opening 36 provided in the housing 10 is closed by a cover 37. Several small pistons 39 abut against the disc 32 and more particularly against its side which faces toward the rotor 18. The small pistons are accommodated in a sealing manner in openings 40 which are provided in the housing 10 and distributed uniformly over its periphery. In the shown example, four such small pistons are provided. They are composed of metallic material with high sliding properties such as for example brass. In addition, springs 41 are accommodated in the openings and pressing against the small pistons 39. The small pistons 39 are loaded with a high pressure from the high pressure side of the machine through suitable openings and passages, for example a passage 42. In this manner, an axial force is applied to the disc 32 and thereby to the shaft 19 and the rotor 18 so as to compensate the above mentioned hydraulic force.

By respective dimensioning of the small pistons, the counter force can be selected so that a suitable surplus force is generated on the shaft in direction toward the cover 37. Thereby the gap between the rotor 18 and the housing which is bridged by a metal disc 43, is maintained sealed in all conditions. The force course (force closure) between the rotor 18, the shaft 19 and the device 31 for the thrust compensation is identified by a thick solid line with arrows. It can be recognized that this force compensation is short-closed, which provides for an especially advantageous construction.

Figure 2:
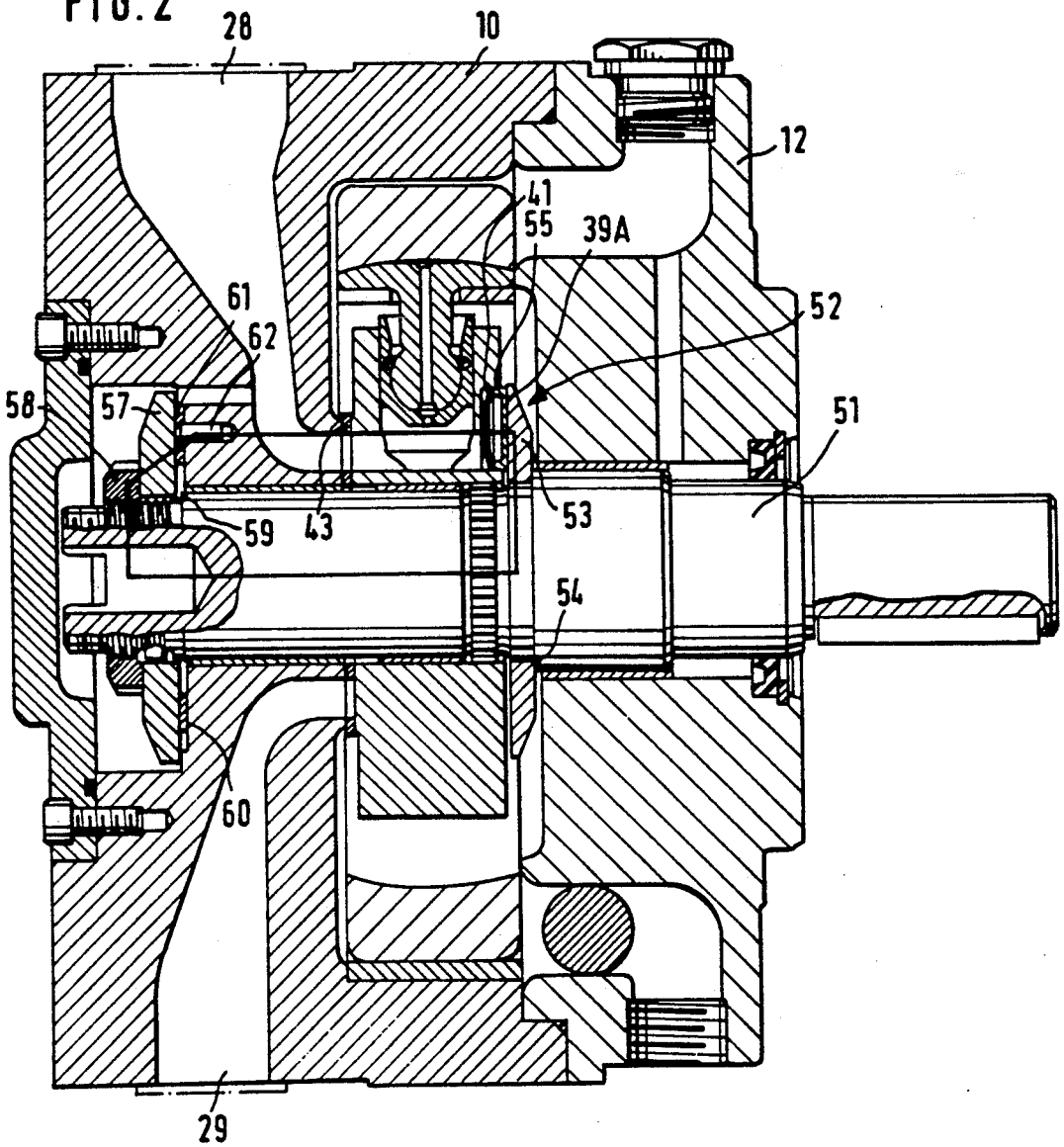
FIGS. 2–4 are views substantially corresponding to the view of FIG. 1 but showing further embodiment of the present invention.

In the embodiment shown in FIG. 2, both the radial piston machine and the thrust compensation are designed differently. The total construction remains substantially the same. However, a rotor which is identified here with reference numeral 50 is formed as a separate part from a shaft 51. It is fixedly connected with the shaft 51 by a multi-wedge connection for joint rotation with the shaft. The device for thrust compensation is identified with reference numeral 52. It has a disc 53 which is fixedly arranged on the shaft 51 between the rotor 50 and the cover 12. It abuts against a shaft shoulder 54. Cylindrical recesses 55 are formed in the rotor 50 at its side facing toward the disc 53. Small pistons 39A are sealingly arranged in the recesses 55 and abut with their bottoms against the disc 53 under fluid pressure originated from the high pressure side of the machine. Since the rotor 50 is fixedly connected with the shaft for joint rotation, an additional device is needed. This device includes a disc 57 which is arranged on the end of the shaft 51 axially displaceably relative to the shaft and rotatable together with the shaft. The disc 57 is pressed against a shaft shoulder 59 by a nut 58. A sliding disc 61 is located between the disc 57 and a facing surface 60 of the housing. The sliding disc 61 is secured by a pin 62 from rotation. It should be mentioned that the shaft 51 is driven directly. The small pistons 39 are composed in this case of a synthetic plastic material, since they do not on the disc 53.

The fluid pressure acting in the machine produces a thrust force on the rotor 50. This force is taken at the disc 53. It is transferred through the shaft to the disc 57 which abuts against the housing via the disc 61. The short-closed force course is identified again by a thick solid line.

Figure 3:
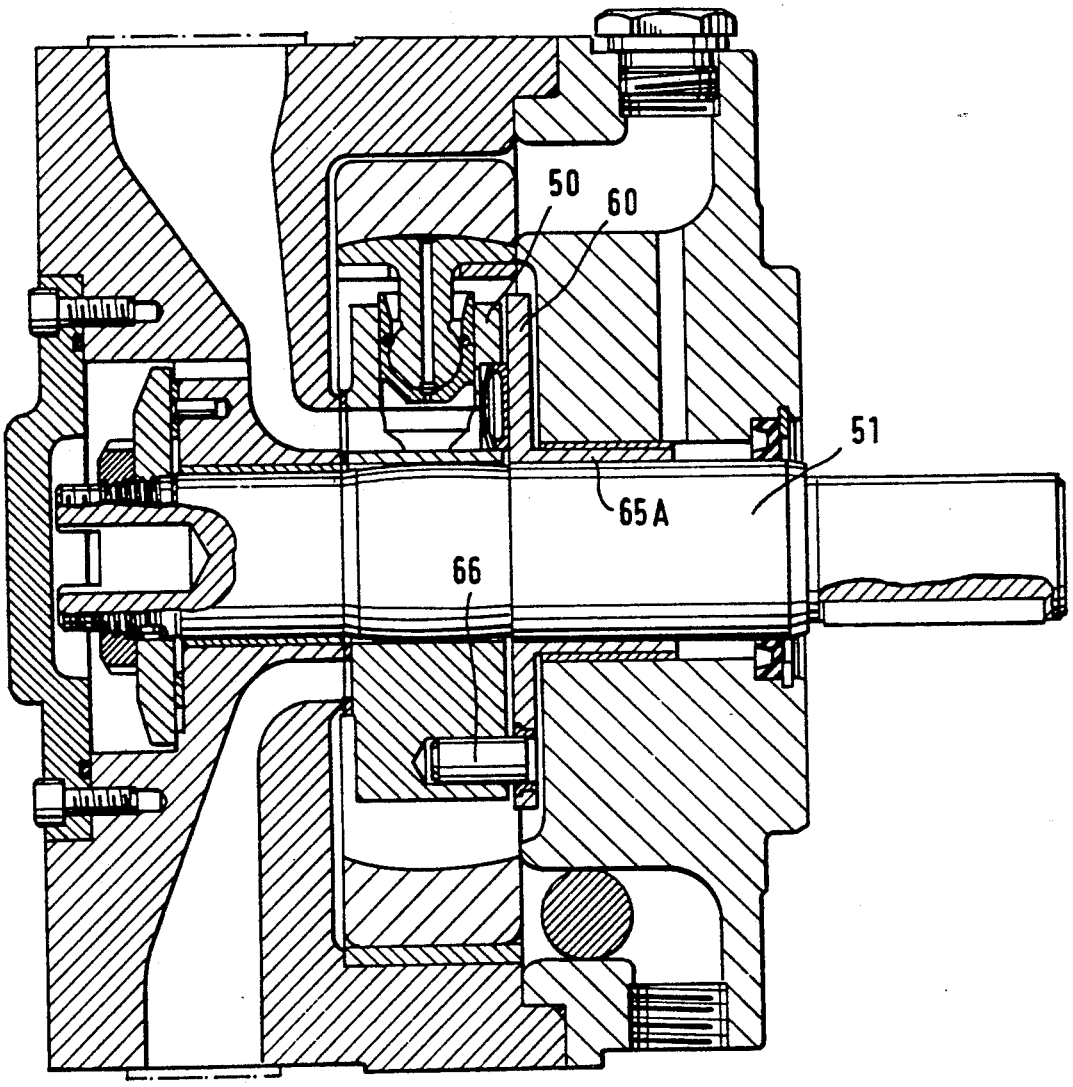

The embodiment shown in FIG. 3 differs from the embodiment of FIG. 2 in that a flange sleeve 65 is fitted on the shaft 51 by its projection 65A. The flange sleeve 60 performs the function of the disc 53 of the embodiment of FIG. 2. In this embodiment the rotor 50 is not mounted on the shaft 51 for joint rotation therewith, but instead is rotated by a pin 66. The latter is mounted in the flange sleeve 60. The force flux for the thrust compensation is here the same as in the preceding embodiment.

Figure 4:
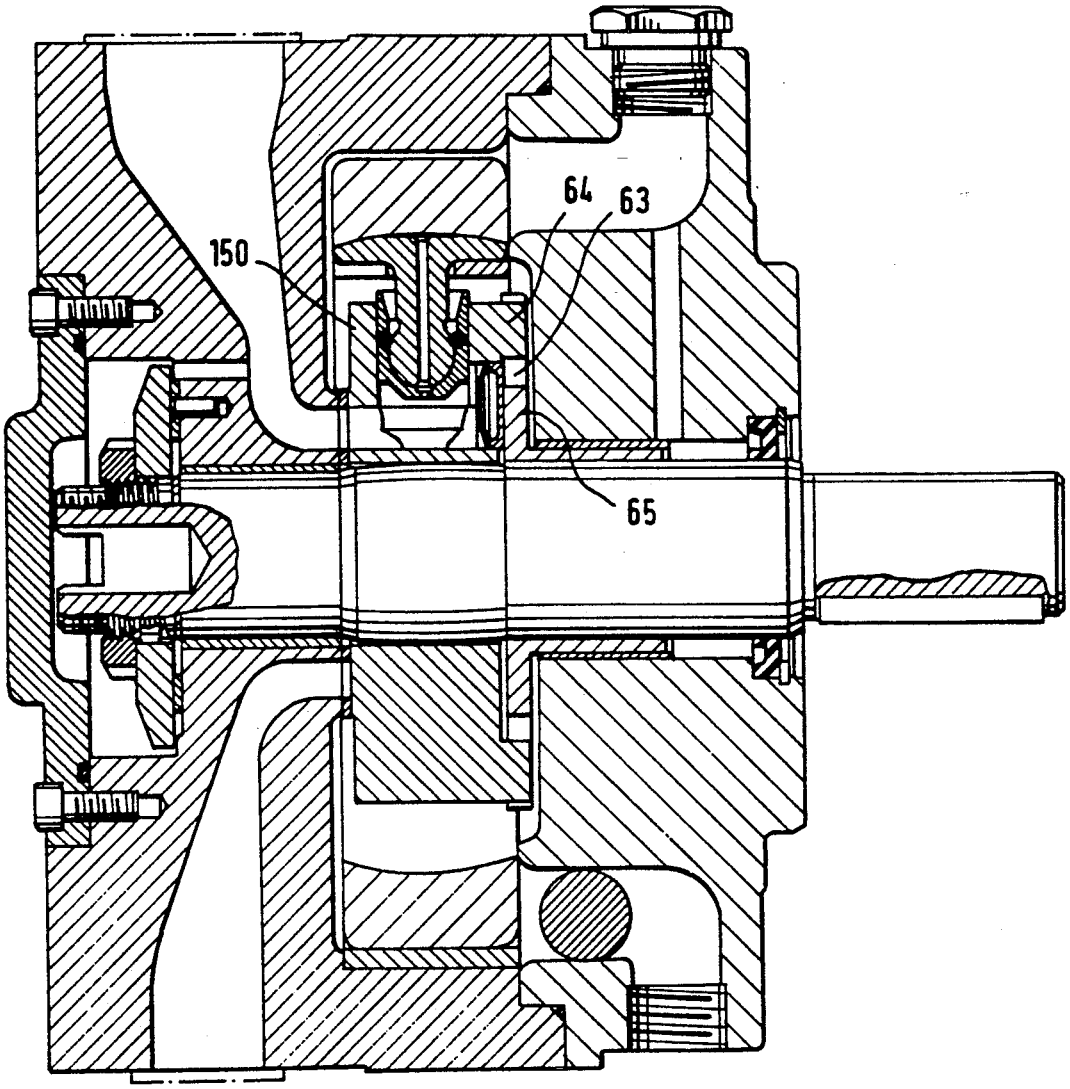

The embodiment shown in FIG. 4 substantially corresponds to the embodiment of FIG. 3. There is however a difference in that a slot 63 is formed in the flange sleeve 65. A projection 64 of a rotor 150 engages in the slot 63 of the flange sleeve.

In all above described embodiments the displaceable arrangement of the small piston 39 provides for a possibility of a post-adjustment. Due to the force transmission through the shaft and the housing (not through the cover) the expansion possibility is limited. This has the advantage in that the material consumption required for a reliable operation of the pump can be reduced. Moreover, an excitation through the bearing cover during pressure variations during piston exchange is dispensed with, so that a favorable noise condition is produced.

It will be understood that each of the elements described above, or two or more together, may also find a useful application in other types of constructions differing from the types described above.

While the invention has been illustrated and described as embodied in a hydrostatic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydrostatic machine, comprising a housing having housing openins; a shaft; a rotor fixed on a shaft for joint rotation therewith and having radially extending openings; a plurality of pistons arranged in said radial openings and having ends extending outwardly beyond said openings; a displacement ring arranged so that said ends of said pistons slide on said ring; means for communicating said openings with a pressure medium and including passages which open laterally at said rotor; means for compensating an axial thrust applied by a pressure medium to the rotor and including pressure medium-actuated additional pistons, said means for compensating also including a disc which is fixedly arranged on said shaft so that said additional pistons abut against said disc and are arranged in said housing openings, said shaft and said rotor being formed on one-piece with one another.

2. A hydrostatic machine as defined in claim 1, wherein said housing openings are arranged over a circle at uniform distances from one another.

3. A hydrostatic machine as defined in claim 1, wherein said additional pistons are composed of a metallic material having high sliding properties.

* * * * *